United States Patent [19]

Funk

[11] 4,381,814

[45] May 3, 1983

[54] CONTROL OF HEAT TRANSFER FROM HEAT EXCHANGERS IN PARALLEL

[75] Inventor: Gary L. Funk, Bartlesville, Okla.

[73] Assignee: Phillips Petroleum Company, Bartlesville, Okla.

[21] Appl. No.: 192,791

[22] Filed: Oct. 1, 1980

[51] Int. Cl.[3] ..... F28F 27/02

[52] U.S. Cl. ..... 165/1; 165/34; 165/39; 165/40

[58] Field of Search ..... 165/39, 40, 101, 34, 165/1

[56] References Cited

U.S. PATENT DOCUMENTS

| | | | |
|---|---|---|---|
| 3,123,086 | 3/1964 | Kleiss | 165/39 X |
| 3,167,113 | 1/1965 | Kleiss | 165/34 X |
| 3,450,105 | 6/1969 | Osburn | 236/20 R |

FOREIGN PATENT DOCUMENTS

| | | | |
|---|---|---|---|
| 169662 | 12/1959 | Sweden | 165/39 |

*Primary Examiner*—Sheldon J. Richter

[57] ABSTRACT

The efficiency of a parallel heat exchanger arrangement is substantially maximized by utilizing the differential temperature across a first heat exchanger or group of heat exchangers in series to derive a set point for the differential temperature across a second heat exchanger or second group of heat exchangers in series required to substantially maximize the efficiency of the parallel heat exchanger arrangement. Fluid flow to the heat exchangers is manipulated so as to force the differential temperature across the second heat exchanger or second group of heat exchangers to equal the derived set point.

8 Claims, 3 Drawing Figures

CONTROL OF HEAT TRANSFER FROM HEAT EXCHANGERS IN PARALLEL

This invention relates to heat transfer. In one aspect this invention relates to method and apparatus for substantially maximizing the efficiency of heat exchangers in parallel.

As used herein the term "parallel heat exchangers" or "heat exchangers in parallel" will be used to refer to a configuration in which at least two heat exchangers are utilized to heat or cool separate fluid streams with the separate fluid streams then being combined. Usually in a parallel heat exchanger arrangement a fluid stream is split to provide at least two separate streams, the separate streams are passed through separate heat exchangers, and the separate streams are then recombined. However, only combination of the separate streams is required. The streams flowing through the heat exchangers may come from different sources.

Also, as used herein "maximizing the efficiency" refers to either maximizing the transfer of heat from the parallel heat exchangers or minimizing the cost of using the parallel heat exchanger arrangement. Generally, maximum heat transfer is the parameter desired but in situations where one of the heating or cooling fluids is considerably more expensive than the others, it may be desirable to minimize the use of the more expensive fluid at the cost of maximum heat transfer.

Figure 1:
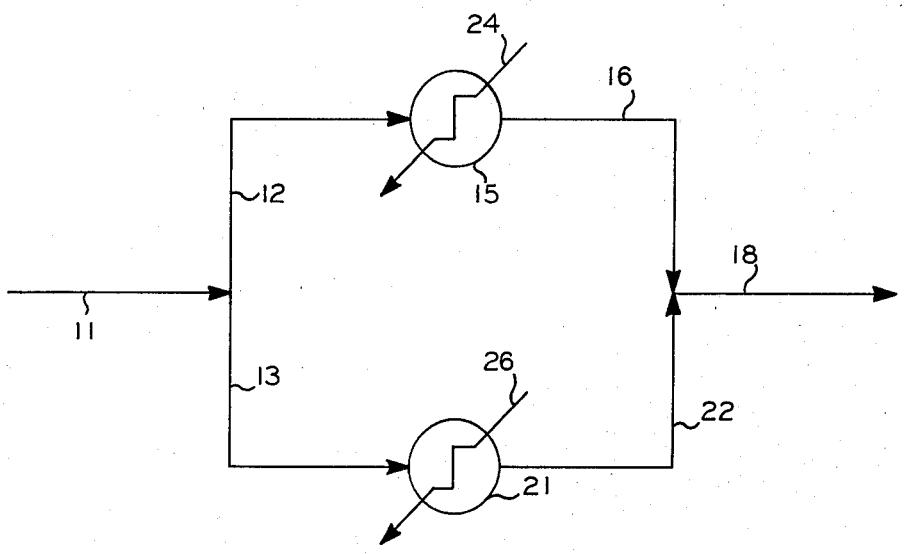

FIG. 1, which is a diagrammatic illustration of a parallel heat exchanger arrangement, will be utilized to provide background information concerning the present invention. Referring now to FIG. 1, a fluid stream flowing through conduit means 11 is split between conduit means 12 and conduit means 13. The fluid flowing through conduit means 12 passes through heat exchanger 15 and is then provided through the combination of conduit means 16 and 18 to a desired destination. In like manner, the fluid flowing through conduit means 13 passes through the heat exchanger 21 and is then provided through the combination of conduit means 22 and 18 to the desired destination. For the sake of illustration, a heating fluid will be considered to be flowing through conduit means 24 to heat exchanger 15 and through conduit means 26 to heat exchanger 21. Obviously a cooling fluid could be flowing through conduit means 24 and 26 if desired.

Essentially, the heat exchangers 15 and 21 are being utilized to heat a fluid stream which flows through conduit means 11. The fluid flowing through conduit means 24 and 26 would generally be two fluid streams which need to be cooled for use in the process. Obviously, a large number of parallel heat exchangers could be utilized if a number of other process streams were available for heating the process stream flowing through conduit means 11. Also a group of heat exchangers could be used for each parallel path. One typical application of parallel heat exchanger arrangements such as that illustrated in FIG. 1 is the preheating of a feed stream flowing to a fractional distillation column. The fluid streams flowing through conduit means 24 and 26 might be side streams which are withdrawn from the fractional distillation column, cooled, and then returned to the fractional distillation column.

The fluid stream flowing through conduit means 24 will typically have a different temperature than the fluid stream flowing through conduit means 26. Also, the characteristics of the heat exchanger 15 and the heat exchanger 21 may vary considerably. If the fluid stream flowing through conduit means 11 is simply split in such a manner that equal portions flow through the heat exchanger 15 and the heat exchanger 21, heat will be wasted which is totally undesirable under modern-day conditions of energy shortages. It is thus an object of this invention to provide method and apparatus for controlling the flow of fluid to heat exchangers in parallel so as to subtantially maximize the efficiency of the heat exchangers in parallel.

The total heat (Q) transferred to the fluid flowing through conduit means 11 per unit time is given by $$Q=[F(T_4-T_2)Cp_2K_2+(1-F)(T_3-T_1)Cp_1K_1]Z \quad (1)$$

where:

$Cp_2$=specific heat of fluid flowing through conduit means 13;

$Cp_1$=specific heat of fluid flowing through conduit means 12;

F=the fraction of the total mass flow through conduit means 11 which flows through conduit means 13;

$K_2$=the weighting factor for the heat exchanger 21;

$K_1$=the weighting factor for the heat exchanger 15;

Z=the total mass flow rate of the fluid flowing through conduit means 11;

$T_1$=the temperature of the fluid flowing through conduit means 12;

$T_2$=the temperature of the fluid flowing through conduit means 13;

$T_3$=the temperature of the fluid flowing through conduit means 16; and $T_4$=the temperature of the fluid flowing through conduit means 22.

Differentiating Equation (1) with respect to F gives $$\frac{dQ}{dF} = [(T_4 - T_2)Cp_2K_2 - (T_3 - T_1)Cp_1K_1]Z \quad (2)$$

The maximum efficiency for the heat exchangers in parallel is given by setting dQ/dF equal to zero. Setting dQ/dF equal to zero and rearranging Equation (2) gives $$\frac{T_4 - T_2}{T_3 - T_1} = \frac{Cp_2K_2}{Cp_1K_2} \quad (3)$$

When the conditions of Equation (3) are satisfied, then the efficiency of the heat exchangers in parallel has been substantially maximized.

For the arrangement illustrated in FIG. 1, $Cp_1$ will typically equal $Cp_2$ because the same fluid is flowing through conduit means 12 and 13. If the weighting factor K is the same for both heat exchangers 15 and 21 then Equation (3) is satisfied when the differential temperature across the heat exchanger 15 is equal to the differential temperature across the heat exchanger 21. If $T_1$ is equal to $T_2$ then $T_3$ will be equal to $T_4$.

In many cases the weighting factor K will not be the same for the heat exchangers 15 and 21 and in some cases $Cp_1$ may not equal $Cp_2$ and $T_1$ may not equal $T_2$. In these cases the outlet temperature from the heat exchangers will not be equal but if Equation (3) is satisfied the maximum heat has been transferred into the fluid stream flowing through conduit means 11.

The weighting factor K takes into account both the heat transfer coefficient for a heat exchanger and the process economics for a heat exchanger. Generally, only the heat transfer coefficient is considered and thus, if the heat exchanger 15 has a higher heat transfer coefficient than the heat exchanger 21, $K_1$ will be greater than $K_2$. If process economics is being considered then, if it is more important from an economic standpoint to cool the fluid flowing through conduit means 24 than it is to cool the process stream flowing through conduit means 26 or the heat supplied from the fluid flowing through conduit means 26 is more valuable than the heat supplied through conduit means 24, again $K_1$ will be greater than $K_2$.

In accordance with the present invention the fluid flow through parallel heat exchangers is manipulated so as to force Equation (3) to be satisfied. In general, this is accomplished by utilizing the differential temperature across a first heat exchanger or group of heat exchangers in series to derive a set point for the differential temperature across a second heat exchanger or second group of heat exchangers in series. Fluid flow to the heat exchangers is manipulated so as to force the differential temperature across the second heat exchanger or second group of heat exchangers to equal the derived set point. In this manner, the conditions of Equation (3) are satisfied and the efficiency of heat exchangers in parallel is substantially maximized.

Figure 2:
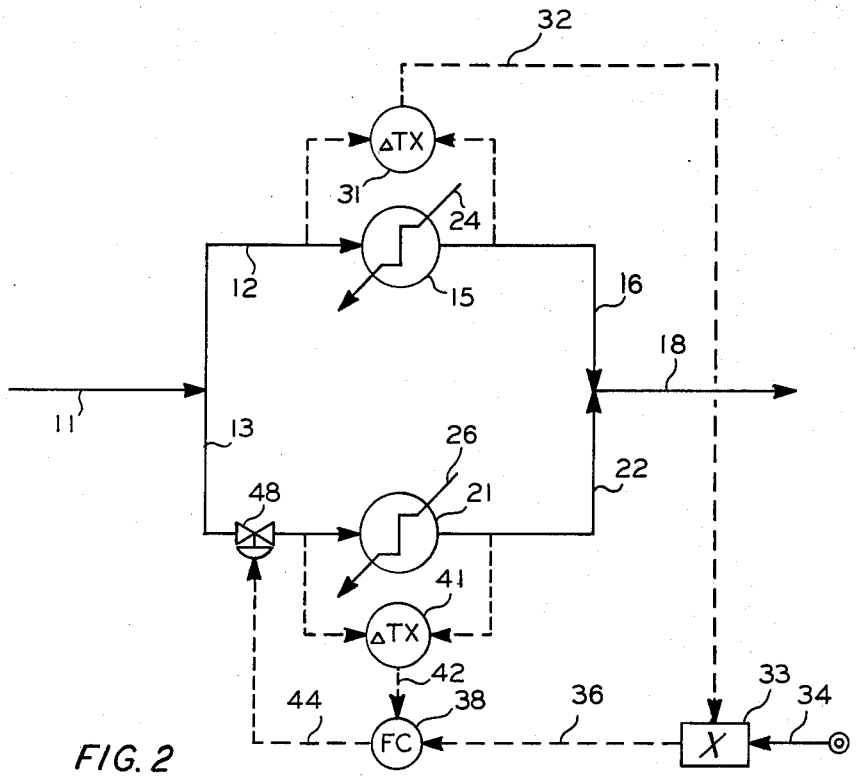
Figure 3:
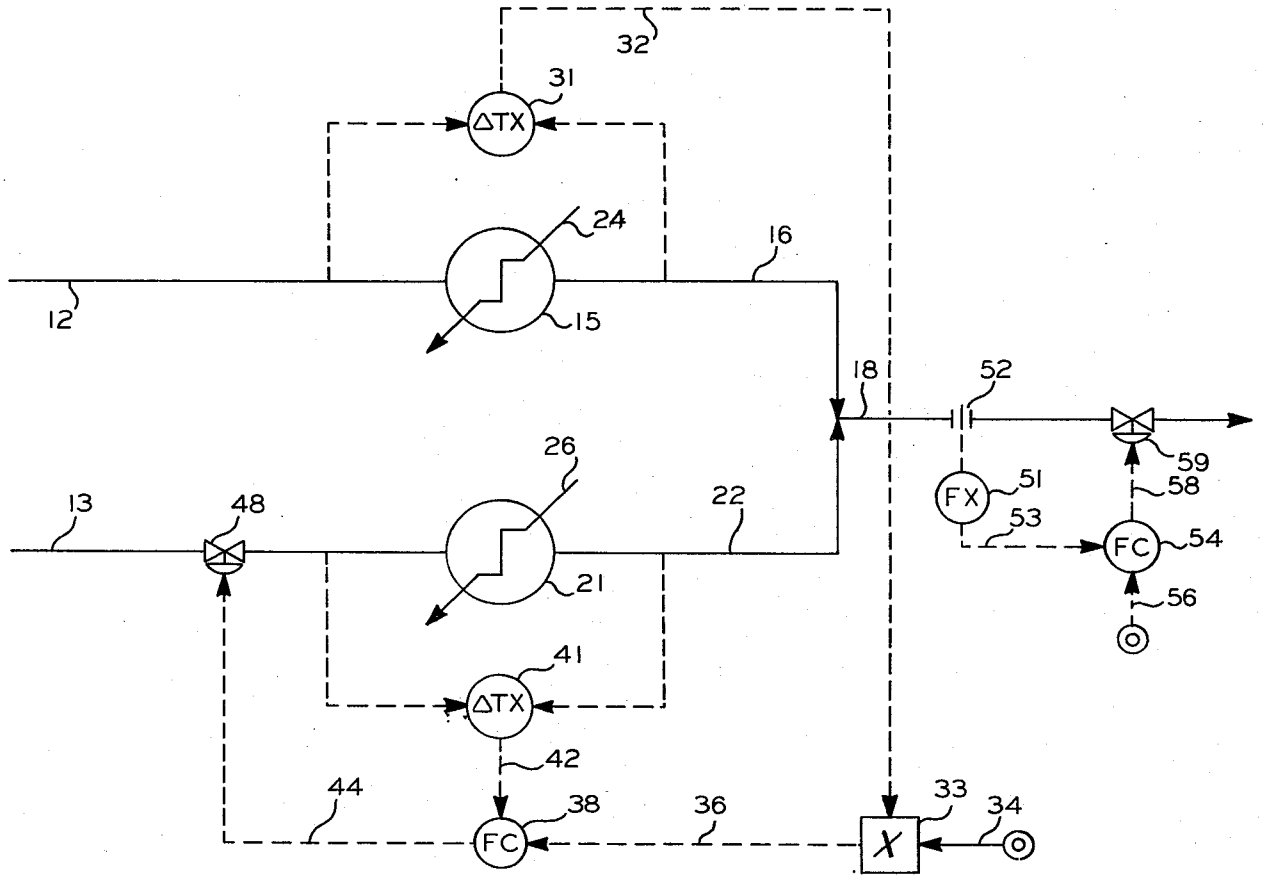

Other objects and advantages will be apparent from the foregoing brief description of the invention and the claims as well as from the detailed description of the drawings in which:

FIG. 1 is a diagrammatic representation of a first parallel heat exchanger configuration;

FIG. 2 is a diagrammatic illustration of the first parallel heat exchanger configuration of FIG. 1 and an associated control system for substantially maximizing the efficiency of the first parallel heat exchanger arrangement; and FIG. 3 is a diagrammatic illustration of a second parallel heat exchanger arrangement and an associated control system for substantially maximizing the efficiency of the second parallel heat exchanger arrangement.

The present invention is described in terms of only two heat exchangers in parallel for the sake of convenience. As has been previously stated, the heat exchangers 15 or 21 illustrated in FIG. 2 could be a large number of heat exchangers. Also, more than two parallel paths could be utilized if desired. In the case of more than two parallel paths the differential temperature for one of the parallel paths is utilized to derive set points for the remaining parallel paths.

The invention is also described in terms of heating the two streams that are combined. However, the two streams that are combined could be cooled if desired. It is required that both streams be either cooled or heated.

A specific control system configuration is set forth in FIGS. 2 and 3 for the sake of illustration. However, the invention extends to different types of control system configurations which accomplish the purpose of the invention. Lines designated as signal lines in the drawings are electrical or pneumatic in this preferred embodiment. Generally, the signals provided from any transducer are electrical in form. However, the signals provided from pressure sensors or flow sensors will generally be pneumatic in form. Transducing of these signals is not illustrated for the sake of simplicity because it is well known in the art that if a flow is measured in pneumatic form it must be transduced to electrical form if it is to be transmtted in electrical form by a flow transducer.

The invention is also applicable to mechanical, hydraulic or other signal means for transmitting information. In almost all control systems some combination of electrical, pneumatic, mechanical or hydraulic signals will be used. However, use of any other type of signal transmission, compatible with the process and equipment in use, is within the scope of the invention.

The controllers shown may utilize the various modes of control such as proportional, proportional-integral, proportional-derivative, or proportional-integral-derivative. In this preferred embodiment, proportional-integral-derivative controllers are utilized but any controller capable of accepting two input signals and producing a scaled output signal, representative of a comparison of the two input signals, is within the scope of the invention. The operation of proportional-integral-derivative controllers is well known in the art. The output control signal of a proportional-integral-derivative controller may be represented as $$S = C_1E + C_2\int Edt + C_3\frac{dE}{dt}$$

where

S=output control signals;

E=difference between two input signals; and

C, $C_2$ and $C_3$=constants.

The scaling of an output signal by a controller is well known in control systems art. Essentially, the output of a controller may be scaled to represent any desired factor or variable. An example of this is where a desired flow rate and an actual flow rate is compared by a controller. The output could be a signal representative of a desired change in the flow rate of some gas necessary to make the desired and actual flow rates equal. On the other hand, the same output signal could be scaled to represent a percentage of full scale or could be scaled to represent a temperature change required to make the desired and actual flow rates equal. If the controller output can range from 0 to 10 volts, which is typical, then the output signal could be scaled so that an output signal having a voltage level of 5.0 volts corresponds to 50 percent, some specified flow rate, or some specified temperature.

Referring now to FIG. 2, the process flow is the same as the process flow described for FIG. 1. The differential temperature transducer 31 in combination with temperature measuring devices such as thermocouples, which are operably located in conduit means 12 and 16, provides an output signal 32 which is representative of the actual differential temperature across the heat exchanger 15. Signal 32 is provided from the differential temperature transducer 31 to the multiplying block 33. Using the terminology of Equation (3), signal 32 is representative of $T_3-T_1$.

The multiplying block 33 is also provided with a signal 34 which, utilizing the terminology of Equation (3), is representative of $Cp_1K_1/Cp_2K_2$. Depending on the values of $Cp_1$, $K_1$, $Cp_2$ and $K_2$, the value of signal 34 may reduce to $Cp_1/Cp_2$, $K_1/K_2$ or simply 1. Signal 32 is multiplied by signal 34 to establish signal 36 which is representative of $(T_3-T_1)(Cp_1K_1/Cp_2K_2)$. Signal 36 is provided from the multiplying block 33 as the set point signal to the flow controller 38. It can be seen that if the differential temperature across the heat exchanger 21 is equal to the value represented by signal 36, then the conditions of Equation (3) are satisfied and maximum heat transfer to the fluid flowing through conduit means 18 will be accomplished.

The differential temperature transducer 41 in combination with temperature measuring devices such as thermocouples, which are operably located in conduit means 13 and 22, provides an output signal 42 which is representative of the actual differential temperature across the heat exchanger 21. Again, utilizing the terminology of Equation (3), signal 42 is representative of $T_4-T_2$. Signal 42 is provided from the differential temperature transducer 41 as the process variable input to the flow controller 38.

The flow controller 38 provides an output signal 44 which is responsive to the difference between signals 36 and 42. Signal 44 is scaled so as to be representative of the flow rate of the fluid flowing through conduit means 13 which is required to make the differential temperature across the heat exchanger 21, as representated by signal 42, substantially equal to the value of the set point signal 36. Signal 44 is provided from the flow controller 38 as a control signal to the pneumatic control valve 48 which is operably located in conduit means 13. The pneumatic control valve 48 is manipulated in response to signal 44 to thereby split the fluid stream flowing through conduit means 11 in such a manner that the efficiency of the parallel heat exchanger arrangement is substantially maximized.

For the process flow illustrated in FIG. 2 the inlet temperatures to the heat exchangers 15 and 21 may be different because of factors such as different lengths of pipe. The heat transfer coefficient of the heat exchangers may vary because of fouling, corrosion or simply because different types of heat exchangers are utilized. Obviously, the temperature of the fluids flowing through conduit means 24 and 26 may vary widely. Under all of these conditions, the control system of the present invention as illustrated in FIG. 2 substantially maximizes the efficiency of the parallel heat exchanger arrangement.

Referring now to FIG. 3, a process flow is illustrated in which a fluid stream is not split between two parallel heat exchangers but the fluid streams flowing through each heat exchanger are combined after passing through the respective heat exchangers. This type of process flow may occur when different feed tanks are being utilized. Under these conditions, the inlet temperature and specific heat of each of the feed streams may vary. The control system acts exactly in the manner described in FIG. 2 with the addition of a flow control on the fluid flowing through conduit means 18. Effectively, the total fluid flow through the conduit means 18 is maintained by utilizing the flow transducer 51 in combination with the flow sensor 52 to establish an output signal 53 which is representative of the actual flow rate of the fluid flowing through conduit means 53. Signal 53 is provided from the flow transducer 51 to the flow controller 54. The flow controller 54 is also provided with a set signal 56 which is representative of the desired flow rate of the fluid flowing through conduit means 18. The flow controller 54 establishes an output signal 58 which is responsive to the difference between signals 53 and 56. The pneumatic control valve 59 which is operably located in conduit means 18 is manipulated in response to signal 58 to thereby maintain the actual flow rate of the fluid flowing through conduit means 18 substantially equal to the desired flow rate as represented by signal 56.

The control system illustrated in FIG. 3 works exactly in the same manner as that described in conjunction with FIG. 2 to substantially maximize the efficiency of the parallel heat exchanger arrangement. This is again accomplished by forcing the ratio of the differential temperature across the heat exchangers to meet the conditions of Equation (3).

The invention has been described in terms of a preferred embodiment as illustrated in the drawings. Specific components used in the practice of the invention as illustrated in the drawings such as the differential temperature transducers 31 and 41; multiplier 33; flow controller 38; pneumatic control valve 48 and 59; flow sensor 52; flow transducer 51; and flow controller 54 are each well known, commercially available control components such as are described at length in Perry's *Chemical Engineer's Handbook*, 4th Edition, Chapter 22, McGraw-Hill.

For reasons of brevity, the process with which the parallel heat exchangers might be associated has not been illustrated as the specific process plays no part in the explanation of the invention.

While the invention has been described in terms of the presently preferred embodiment, reasonable variations and modifications are possible by those skilled in the art, within the scope of the described invention and the appended claims. Variations such as utilizing multiple heat exchangers in each parallel path or utilizing more than two parallel paths are within the scope of the invention.

That which is claimed is:

1. Apparatus comprising:

a first heat exchanger;

a second heat exchanger;

means for providing a first fluid stream to said first heat exchanger;

means for providing a second fluid stream to said first heat exchanger, wherein said first fluid stream is passed in heat exchange relationship with said second fluid stream in said first heat exchanger;

means for withdrawing said first fluid stream as a first effluent stream from said first heat exchanger;

means for providing a third fluid stream to said second heat exchanger;

means for providing a fourth fluid stream to said second heat exchanger, wherein said third fluid stream is passed in heat exchange relationship with said fourth fluid stream in said second heat exchanger, wherein the temperature of said fourth fluid stream is greater than the temperature of said third fluid stream if the temperature of said second fluid stream is greater than the temperature of said first fluid stream and wherein the temperature of said fourth fluid stream is less than the temperature of said third fluid stream if the temperature of said second fluid stream is less than the temperature of said first fluid stream;

means for withdrawing said third fluid stream as a second effluent stream from said second heat exchanger;

means for combining said first effluent stream and said second effluent stream to form a combined stream;

means for establishing a first signal representative of the actual difference between the temperature of said first effluent stream and the temperature of said first fluid stream entering said first heat exchanger;

means for establishing, in response to said first signal, a second signal representative of the difference in the temperature of said second effluent stream and the temperature of said third fluid stream entering said second heat exchanger required to substantially maximize the efficiency of the parallel combination of said first and second heat exchangers;

means for establishing a third signal representative of the actual difference between the temperature of said second effluent stream and the temperature of said third fluid stream entering said second heat exchanger;

means for comparing said second signal and said third signal and for establishing a fourth signal responsive to the difference between said second signal and said third signal; and means for manipulating the flow of said first fluid stream to said first heat exchanger and the flow of said third fluid stream to said second heat exchanger in response to said fourth signal to thereby maintain the differential temperature across said second heat exchanger as represented by said third signal substantially equal to the required differential temperature across said second heat exchanger as represented by said second signal.

2. Apparatus in accordance with claim 1 wherein said means for establishing said second signal in response to said first signal comprises:

means for establishing a fifth signal representative of $Cp_1K_1/Cp_2K_2$ where:

$Cp_1$=specific heat of said first fluid stream;

$Cp_2$=specific heat of said third fluid stream;

$K_1$=the weighting factor for said first heat exchanger; and $K_2$=the weighting factor for said second heat exchanger;

means for multiplying said first signal and said fifth signal to establish said second signal.

3. Apparatus in accordance with claim 2 wherein a fifth fluid stream is divided to form said first fluid stream and said third fluid stream and wherein said means for manipulating the flow of said first fluid stream to said first heat exchanger and the flow of said third fluid stream to said second heat exchanger in response to said fourth signal comprises:

a control valve means operatively located so as to control the flow of said third fluid stream; and means for manipulating said control valve means in response to said fourth signal to thereby directly manipulate the flow of said third fluid stream to said second heat exchanger and indirectly manipulate the flow of said first fluid stream to said first heat exchanger by controlling the division of said fifth fluid stream into said first fluid stream and said third fluid stream.

4. Apparatus in accordance with claim 2 wherein said means for manipulating the flow of said first fluid stream to said first heat exchanger and the flow of said third fluid stream to said second heat exchanger in response to said fourth signal comprises:

means for establishing a sixth signal representative of the desired flow rate of said combined fluid stream;

means for establishing a seventh signal representative of the actual flow rate of said combined fluid stream;

means for comparing said sixth signal and said seventh signal and for establishing an eighth signal responsive to the difference between said sixth signal and said seventh signal;

means for manipulating the flow rate of said combined fluid stream in response to said eighth signal;

a control valve means operably located so as to control the flow of said third fluid stream; and means for manipulating said control valve means in response to said fourth signal to thereby directly manipulate the flow of said third fluid stream to said second heat exchanger and indirectly manipulate the flow rate of said first fluid stream to said first heat exchanger since the flow rate of said combined steam is controlled.

5. In a parallel heat exchanger arrangement wherein first and second fluid streams are passed in heat exchange relationship in a first heat exchanger, wherein third and fourth fluid streams are passed in heat exchange relationship in a second heat exchanger, wherein said first fluid stream and said third fluid stream are combined after passing through said first heat exchanger and second heat exchanger respectively to form a combined stream, wherein the temperature of said fourth fluid stream is greater than the temperature of said third fluid stream if the temperature of said second fluid stream is greater than the temperature of said first fluid stream and wherein the temperature of said fourth fluid stream is less than the temperature of said third fluid stream if the temperature of said second fluid stream is less than the temperature of said first fluid stream, a method for substantially maximizing the efficiency of the parallel combination of said first and second heat exchangers comprising the steps of:

establishing a first signal representative of the differential temperature across said first heat exchanger;

establishing, in response to said first signal, a second signal representative of the differential temperature across said second heat exchanger required to substantially maximize the efficiency of the parallel combination of said first and second heat exchangers;

establishing a third signal representative of the actual differential temperature across said second heat exchanger;

comparing said second signal and said third signal and establishing a fourth signal responsive to the difference between said second signal and said third signal; and manipulating the flow of said first fluid stream to said first heat exchanger and the flow of said third fluid stream to said second heat exchanger in response to said fourth signal to thereby maintain the differential temperature across said second heat exchanger as represented by said third signal substantially equal to the required differential temperature across said second heat exchanger as represented by said second signal.

6. A method in accordance with claim 5 wherein said step of establishing said second signal in response to said first signal comprises:

establishing a fifth signal representative of $Cp_1K_1/Cp_2K_2$ where:

$Cp_1$=specific heat of said first fluid stream;

$Cp_2$=specific heat of said third fluid stream;

$K_1$=the weighting factor for said first heat exchanger; and $K_2$=the weighting factor for said second heat exchanger;

multiplying said first signal and said fifth signal to establish said second signal.

7. A method in accordance with claim 6 wherein a fifth fluid stream is divided to form said first fluid stream and said third fluid stream and wherein said step of manipulating the flow of said first fluid stream to said first heat exchanger and the flow of said third fluid stream to said second heat exchanger in response to said fourth signal comprises manipulating a control valve means operatively located so as to control the flow of said third fluid stream in response to said fourth signal to thereby directly manipulate the flow of said third fluid stream to said second heat exchanger and also indirectly manipulate the flow of said first fluid stream to said first heat exchanger by controlling the division of said fifth fluid stream is divided into said first fluid stream and said third fluid stream.

8. A method in accordance with claim 6 wherein said step of manipulating the flow of said first fluid stream to said first heat exchanger and the flow of said third fluid stream to said second heat exchanger in response to said fourth signal comprises:

establishing a sixth signal representative of the desired flow rate of said combined fluid stream;

establishing a seventh signal representative of the actual flow rate of said combined fluid stream;

comparing said sixth signal and said seventh signal and establishing an eighth signal responsive to the difference between said sixth signal and said seventh signal;

manipulating the flow rate of said combined fluid stream in response to said eighth signal; and manipulating a control valve means operably located so as to control the flow of said third fluid stream in response to said fourth signal to thereby directly manipulate the flow of said third fluid stream to said second heat exchanger and indirectly manipulate the flow rate of said first fluid stream to said first heat exchanger since the flow rate of said combined stream is controlled.

* * * * *